US008596003B2

(12) United States Patent
Attia et al.

(10) Patent No.: US 8,596,003 B2
(45) Date of Patent: Dec. 3, 2013

(54) MODULAR ACOUSTIC CONFIGURATION FOR CREATING A FLOOR WITH IMPROVED ACOUSTIC INSULATION PERFORMANCES, AND METHOD FOR IMPLEMENTING SAME

(75) Inventors: Patrick Attia, Paris (FR); Daniel Attia, Paris (FR); Samuel Sibony, Paris (FR)

(73) Assignees: Patrick Attia, Paris (FR); Daniel Attia, Paris (FR)

( * ) Notice: Subject to any disclaimer, the term of this patent is extended or adjusted under 35 U.S.C. 154(b) by 0 days.

(21) Appl. No.: 12/921,803

(22) PCT Filed: Mar. 12, 2009

(86) PCT No.: PCT/FR2009/050414

§ 371 (c)(1),
(2), (4) Date: Dec. 22, 2010

(87) PCT Pub. No.: WO2009/122068

PCT Pub. Date: Oct. 8, 2009

(65) Prior Publication Data

US 2011/0107691 A1 May 12, 2011

(30) Foreign Application Priority Data

Mar. 13, 2008 (FR) ..... 08 51641

(51) Int. Cl.
*E04B 1/82* (2006.01)
*E04F 15/22* (2006.01)

(52) U.S. Cl.
USPC ..... 52/403.1; 52/144

(58) Field of Classification Search
USPC ..... 52/144, 145, 236.3, 403.1, 480; 181/284, 286, 290, 291, 294
See application file for complete search history.

(56) References Cited

U.S. PATENT DOCUMENTS 2,115,238 A * 4/1938 Stevens ..... 52/402
RE26,239 E * 7/1967 Rockabrand ..... 52/403.1

(Continued)

FOREIGN PATENT DOCUMENTS

BE 433 287 A 4/1939
DE 202 00 235 U1 5/2003

(Continued)

OTHER PUBLICATIONS

"Understanding Properties of Commercial OSB Products", The 7th Pacific Rim Biop-Based Composites Symposium, Wang et al. Oct. 31-Nov. 2, 2004.*

(Continued)

*Primary Examiner* — Ryan Kwiecinski
(74) *Attorney, Agent, or Firm* — Young & Thompson

(57) ABSTRACT

An acoustic configuration (1) for acoustic insulation, with the configuration includes a floor covering (5) attached to a floating floor with elastic skates (4) resting on a substrate (3) (10), the floating floor including skates (4) that are substantially elastic. The floating floor consists of a modular assembly of prefabricated rigid panels (2) with a density of 0.5 to 6, positioned edge to edge with an element of position adjustment that is either male or female, with the skates being homogeneous one-piece elements attached inside the panel, and with the total seat surface ratio Sta of the skates on the substrate on the total surface area Stp of the panel, Sta/Stp being 0.03 to 0.08. In one variant, shims are interposed between the skates and the panel. In the implementation method, a layer of fibrous insulation can be interposed between the substrate and the floating floor.

13 Claims, 2 Drawing Sheets

(56) References Cited

U.S. PATENT DOCUMENTS

| | | | | |
|---|---|---|---|---|
| 4,316,297 | A | 2/1982 | Geist | |
| 4,860,516 | A * | 8/1989 | Koller et al. | 52/480 |
| 4,879,857 | A * | 11/1989 | Peterson et al. | 52/403.1 |
| 5,369,927 | A * | 12/1994 | Counihan | 52/403.1 |
| 5,377,471 | A * | 1/1995 | Niese | 52/482 |
| 5,412,917 | A * | 5/1995 | Shelton | 52/403.1 |
| 5,475,959 | A * | 12/1995 | Mackenzie | 52/403.1 |
| 5,682,724 | A | 11/1997 | Randjelovic | |
| 5,778,621 | A * | 7/1998 | Randjelovic | 52/403.1 |
| 6,055,785 | A * | 5/2000 | Counihan | 52/403.1 |
| 6,115,981 | A * | 9/2000 | Counihan | 52/403.1 |
| 6,158,185 | A * | 12/2000 | Counihan | 52/403.1 |
| 6,230,460 | B1 * | 5/2001 | Huyett | 52/403.1 |
| 6,557,314 | B2 * | 5/2003 | Shelton | 52/480 |
| 2002/0108341 | A1 * | 8/2002 | Hamar | 52/403.1 |
| 2005/0193670 | A1 * | 9/2005 | Niese et al. | 52/403.1 |
| 2007/0000198 | A1 * | 1/2007 | Payne et al. | 52/414 |
| 2009/0211192 | A1 * | 8/2009 | Valentine | 52/403.1 |
| 2010/0205885 | A1 * | 8/2010 | Randjelovic | 52/403.1 |

FOREIGN PATENT DOCUMENTS

| | | | |
|---|---|---|---|
| JP | 1-137064 | A | 5/1989 |
| JP | 6-146543 | A | 5/1994 |

OTHER PUBLICATIONS

"Chapter 33—Mechanical Properties of Rubber", Harris' Shock and Vibration Handbook, Ronald Shaefer, Fifth Edition, 2002.*

"Plywood Density", Mason Pan, Mar. 27, 2009, http://www.plywood.cc/2009/03/27/plywood-density/.*

International Search Report, dated Sep. 23, 2009, from corresponding PCT application.

* cited by examiner

MODULAR ACOUSTIC CONFIGURATION FOR CREATING A FLOOR WITH IMPROVED ACOUSTIC INSULATION PERFORMANCES, AND METHOD FOR IMPLEMENTING SAME

The present invention relates to a modular acoustic complex for making a floor with improved acoustic insulation performances, and a method for implementing the same. It has applications in the field of civil engineering and notably the building and renovation of premises, and more particularly with regard to their floors. It notably makes it possible to make, in new or renovated housing dwellings, a light floating acoustic floor that attenuates and isolates the footstep noises (impact noises) between stacked flats, and also improves the airborne noise insulation performances.

BACKGROUND OF THE INVENTION

Nowadays, the impact noise insulation between flats is made by a floating screed, typically made of reinforced concrete, laid on a resilient acoustic sub-layer, the whole thickness being about 60 mm. The present solution meets the New Acoustic Regulation (NRA, "Nouvelle Réglementation Acoustique" in French) dated January 1996, but has the following implementation drawbacks: long drying time; heavier floor in collective dwellings; tricky implementation due to the phonic bridge between stacked flats (the resilient sub-layer at the periphery of the screed not raised).

Floor systems intended to attenuate the acoustic transmission are also known by the following documents: U.S. Pat. No. 5,369,927; U.S. Pat. No. 6,055,785; JP-6146543; U.S. Pat. No. 5,682,724; U.S. Pat. No. 4,879,857.

SUMMARY OF THE INVENTION

The solution of the present invention consists in making on the floor of new or renovated housing dwellings a relatively light acoustic complex that attenuates and isolates the footstep noises and, more generally, the impact noises, between stacked flats. This impact noise insulation preferably meets the New Acoustic Regulation of January 1996 for the new dwellings. The impact noise insulation improves the acoustic insulation performances for old dwellings.

The proposed method consists in laying, on a slab or joist-type support in a room of a new or old dwelling, rigid prefabricated panels having a density higher than or equal to 0.5 g/cm$^3$ and lower than or equal to 6 g/cm$^3$, with flexible acoustic pads at the under-face thereof. These panels are assembled together while being acoustically separated from the support by the pads and, at the periphery of the room, by a resilient strip. A 1.5 mm-expansion joint will have to be provided over the periphery. These assembled panels form a floating floor. A preferably heavy floor covering, for example of the massive wood flooring or tiling type, is stuck to the panel. The floating floor and its floor covering form the acoustic complex.

Accordingly, the invention relates to an acoustic complex for making a floor with improved acoustic insulation performances, the acoustic complex comprising a floor covering fastened to a floating floor resting on a support, said floating floor comprising substantially elastic pads.

According to the invention, the floating floor is formed of a modular set of rigid prefabricated panels having a density comprised between 0.5 g/cm$^3$ and 6 g/cm$^3$, limits included, the panels comprising peripheral edges and the making of the floating floor being carried out by positioning the panels edge-to-edge, at least one of said peripheral edges of each panel comprising a means for adjusting 15 the panel edge-to-edge positioning, the adjustment means being either one of two male and female complementary types capable of coming into mutual engagement, and the substantially elastic pads are homogenous single-piece elements fastened to the lower face of the panel, each of said pads being substantially of parallelepiped shape, the ratio of the total seating surface area 20 Sta of the pads on the support to the total surface area of the panel Stp, i.e. Sta/Stp, being comprised between 0.03 and 0.08 (i.e. a percentage of 3% to 8%).

In various implementation embodiments of the invention, the following means are used, either alone or in any technically possible combination:

the prefabricated panel comprises on its surface a floor covering fastened to the upper face of the rigid panel, the floor covering is fastened to the upper face of the prefabricated panel(s) after the floating floor has been installed on the support, the acoustic complex comprises on its surface a floor covering stuck on the upper face of the rigid panel(s), said floor covering having a mass per unit area of at least 10 kg/m$^2$, the acoustic complex has a mass per unit area of at least 25 kg/m$^2$, the floating floor having a mass per unit area of at least 15 kg/m$^2$, the panel has a mass per unit area greater than or equal to 15 kg/m$^2$, the panel has a mass per unit area greater than or equal to 25 kg/m$^2$, the pads are made of an elastic material having the following approximate mechanical characteristics:

Static modulus of elasticity: about 0.10 to 0.44 and Dynamic modulus of elasticity: about 0.15 to 1.10 (N/mm$^2$);

Compression strain: about 4.1%;

Tensile strength: about 0.3 N/m;

Elongation at break: about 60%;

Tear strength: about 3 N/mm.

the panel is of the OSB type (Oriented Strand Board panel), the panel is wood-based and is chosen among plywood, pressed wood or rough wood, the panel is water repellent or treated to be water repellent, the panel is a composite of concrete and fibres, the panel is substantially polygonal, the panel is substantially rectangular, the panel is substantially square, the panel has a length comprised between 100 mm and 5000 mm, a width comprised between 100 mm and 5000 mm, a thickness between 4 mm and 200 mm, the panel dimensions are about 1250 mm×800 mm×22 mm, the panel has a thickness of at least 4 mm, the panel has a thickness of about 22 mm, the adjustment means is of the tenon and mortise type, for the male and female type respectively, the panel comprises four peripheral edges and the male adjustment means is placed on two sides and the female adjustment means is placed on the two other sides, the adjustment means is further a fastening means, the adjustment means comprising further a device for a quick connection between the two male and female complementary types, the floor covering is chosen among Linoleum®, carpet, paving, tiling, wood (rough or finished wood flooring, laminated flooring or floating wood flooring), the floor covering is stuck to the panel(s), the floor covering is stuck to the panel(s) and is chosen among a tiling or a rough or finished wood flooring, the floor covering has a mass per surface unit of at least 10 $kg/m^2$, the floor covering has a mass per surface unit comprised between 10 and 90 $kg/m^2$, it is preferable that the acoustic complex has a mass per surface unit greater than or equal to 25 $kg/m^2$ whatever the load proportions between the floating floor and the floor covering, the pads are stuck under the panel, forming discontinuous lines parallel to each other (or randomly arranged but homogeneously distributed), the pads have a length comprised between 50 mm and 150 mm, a width comprised between 25 mm and 100 mm, a non-compressed thickness comprised between 15 mm and 60 mm, the pads have dimensions of about 100 mm×50 mm×17 mm (in the non-compressed condition), the pads have all the same dimensions for a given structure, the pads have different dimensions for a given structure, the pads are arranged in parallel discontinuous lines under the panel, the spacing between two successive discontinuous lines of pads corresponds to the standard joist spacing of a support (notably for rehabilitation implementations of the structures), the spacing between two successive discontinuous lines of pads is about 40 cm, the pads have dimensions of about 100 mm×50 mm×17 mm and the panel dimensions are about 1250 mm×800 mm×22 mm, wood shims with a thickness comprised between 0 (limit excluded) and 500 mm are arranged between the lower face of the panel and each of the pads, the pads are stuck directly under the panel or to wood shims that are fastened under the panel, forming parallel discontinuous lines.

The invention also relates to a method of making an acoustic complex forming a floor with improved acoustic insulation performances, the acoustic complex comprising a floor covering fastened to a floating floor resting on a support, said floating floor comprising substantially elastic pads.

According to the method, the floating floor is formed by assembling on the support panels having one or several of the described characteristics, said panels being arranged edge-to-edge.

In an alternative embodiment of the method, the acoustic complex is located in a room lined with walls, and said acoustic complex and said walls are acoustically separated by placing at least one strip of a resilient material along the walls, between the acoustic complex periphery and said walls. In an alternative embodiment, the strip is an open or closed cell material (strip of foam).

In alternative embodiments, a layer of insulating fibrous material (glass wool or equivalent) is applied on the support before the panels are installed. Preferably, the non-compressed glass wool (or equivalent) has a thickness comprised between 20 and 500 mm.

In alternative embodiments, all the materials and elastic supports (pads) meet the load and rigidity characteristics (for the materials) and the dynamic stiffness characteristic (for the elastic support).

In alternative embodiments, two floating floors are stacked on each other.

In alternative embodiments, the invention is characterized by the inversion of the pad and the corresponding shim, i.e. the interposition of the pad between the panel and the shim, said shim being preferably fastened to the support.

The acoustic complex of the invention has the advantage that it allows a quick installation with very high impact noise acoustical insulation performances and with a cost equivalent to that of the conventional systems. It ensures a high attenuation of low frequency sounds. The invention makes it easy to assemble independent modular elements, which are panels with pads and possibly shims, and increases the production throughput on a work site. In particular, there is no waiting time for the drying of the conventional concrete screed, besides which it avoids the associated humidity problems. Moreover, because the implemented panels are modular, it is possible to replace one or several panels, as needed, to make reparations. The invention makes it possible to avoid the phonic brides existing on a conventional screed, which provides high impact noise insulation performances. The proposed structure is about six times lighter than a conventional acoustic floating screed. It may be made from recycled materials. Finally, it allows a use as heating floor with good high energy performances. It is also possible to place technical elements at the level of the shim.

BRIEF DESCRIPTION OF THE DRAWINGS

The present invention will now be exemplified, without thereby being limited, by the following description of embodiments, with reference to the appended drawings, in which.

DETAILED DESCRIPTION OF THE PREFERRED EMBODIMENTS

Figure 1:
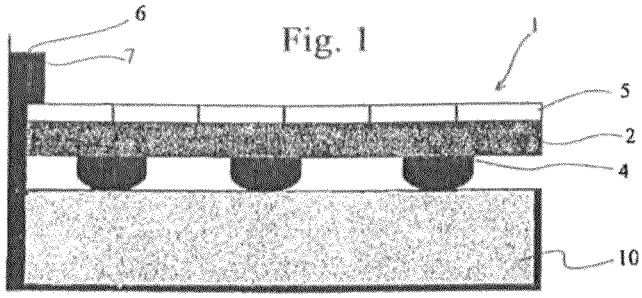
FIG. 1 illustrates a cross-sectional view of a first example of an acoustic complex made by assembling several panels, in the case of a concrete support, in particular in a new building.

In an exemplary basic embodiment, the invention consists in laying, on floors (the support) of new or old dwellings, rigid panels having a density higher than or equal to 0.5 $g/cm^3$ and lower than or equal to 6 $g/cm^3$, with flexible acoustic pads stuck to the under-face thereof. These panels are assembled together to form a floating floor, while being acoustically separated from the support by the pads and, at the periphery, by a resilient strip along the walls. The panels have a 1.5 mm-by-meter expansion joint. Typically, a heavy floor covering of the massive wood flooring or specific-load tiling type, is then stuck, such coating entering into the constitution of the acoustic complex.

Accordingly, the acoustic insulation (isophonic) floating floor is composed of prefabricated modular structures made of rigid and water-repellent wood panels of the OSB4 type (Oriented Strand Board panel) or equivalent, assembled together and comprising, stuck to the under-face thereof, flexible acoustic resilient elements referred to as pads. The thickness of the panels is at least 15 mm, and they have a mass per surface unit greater than or equal to 25 kg/m$^2$. Each panel of typical dimensions 1250 mm×800 mm×22 mm has pads at the under-face thereof, each pad having a height of at least 17 mm and typical dimensions of 100 mm×50 mm×25 mm. These pads are typically arranged every 40 cm, which allows the panels to be laid on any type of support, new or old ones, of the concrete, wood or slab flooring type. On the panel(s) is stuck a heavy floor covering of the massive wood flooring or heavy tiling type. This floor coating has a mass per surface unit of at least 10 kg/m$^2$ and typically between 10 and 15 kg/m$^2$. The panels and pads alone (the floating floor) have a mass per unit area of typically at least 30 kg/m$^2$. Therefore, the acoustic complex (floor covering+panels+pads) has a mass per unit area of 40 kg/m$^2$ at the minimum.

Each of the pads has typical dimensions of 100×50×25 mm and is composed of polyurethane-linked rubber granulates. The material of this type of pad has the following intrinsic mechanical characteristics:

Static modulus of elasticity: 0.10-0.44 and Dynamic modulus of elasticity: 0.15-1.10 (N/mm$^2$);

Compression strain: 4.1%;

Tensile strength: 0.3 N/m;

Elongation at break: 60%;

Tear strength: 3 N/mm.

To obtain the results in terms of acoustic insulation, it is not much the material composition of the pads that is important than the mechanical characteristics thereof, in particular regarding the elasticity. Accordingly, the invention may be implemented with elastic pads made of other materials, for example elastomeric, rubber or other materials, which will preferably have mechanical characteristics identical or similar to the above-listed ones (modulus of elasticity, deformation . . . ). The pad may be patterned (for example corrugated) on the support-side face.

The typical implantation is carried out as follows. First, the floor flatness and humidity rate are controlled, and are corrected if necessary. The panels, which are tongued and grooved and which comprise pads, are arranged on the support and assembled together by being stuck and thus nested into each other to form a coherent floating floor in the considered room. An expansion joint of about 1.5 mm by linear metre of floor (as measured perpendicularly to the edge) is provided along the peripheral edges of the acoustic complex. The panels are separated from the peripheral sidewalls by a foam joint placed inside the expansion joint.

FIG. 1 shows a cross-section of the acoustic complex 1 made by assembling edge-to-edge panels 2 having a mass per surface unit of 30 kg/m$^2$, on which is stuck a floor covering 5, for example a tiling, having a mass par surface unit of 10 kg/m$^2$, and under which are stuck pads 4 of about 17 mm thick (in practice, a little bit thinner because of the pad compression). The pads rest on a support, which is a 14 cm concrete bearing slab 10. Laterally, along the walls, the complex is acoustically separated from said walls by a vertical foam strip 6 on which is fastened a skirting board 7, the skirting board coming, at the periphery, onto the floor coating 5.

Figure 2:
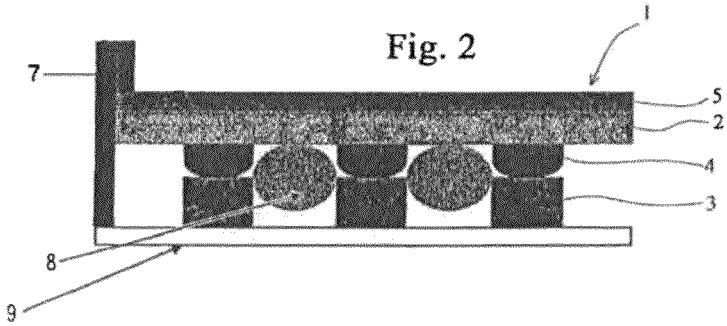
FIG. 2 illustrates a cross-sectional view of a second example of an acoustic complex made by assembling several panels, in the case of a joist support, in particular in an old building after a renovation, and in which an insulation by packing glass wool between the pads and the joists is further implemented.

In FIG. 2, the acoustic complex rests on a support made of joists 3, and the pads 4 are accordingly aligned and spaced relative to each other. A packing of glass wool 8 is carried out between the plaster ceiling 9 of the lower storey and the panels 2, without the glass wool extends under the pads. It will be seen hereinafter that it is preferable that the glass wool also extends under the pads.

In the figures, for purpose of simplification, the panel edges are shown as being substantially straight but, preferably, the panel edges comprise means for relative positioning of the panels, of the tenon and mortise type. Preferably, the tenon height (and thus that of the mortise, to within the clearance) represents about 50% of the panel thickness. Therefore, for an approximately 38 mm thick panel, the tenon and the mortise are each about 19 mm high. Thus, for installation, the panels are nested into each other, edge to/against edge, and said edges are stuck together.

Figure 3:
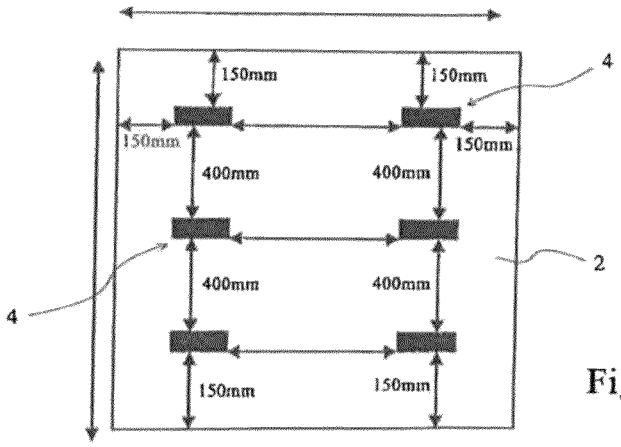
FIG. 3 illustrates a bottom (under-face) view of a prefabricated panel with its pads, showing an example of distribution of said pads.

In FIG. 3, the arrangement of the pads 4 into parallel discontinuous lines on the lower face of the panel 2 is best seen. The lines are spaced by a distance that corresponds preferably to the standard joist spacing, i.e. about 40 cm. The spacing of the pads along a line is preferably essentially adapted so that the expected ratio of the total pad surface area to the panel surface area can be respected. It is also possible to obtain this ratio by acting on the pad unitary dimensions, for example by increasing or reducing the length and/or width thereof.

The invention makes it possible to filter out the floor impact noises due to footsteps, jumping, running, or any kink of displacement. The filtering is made according to the mass-spring principle, which allows a significant low-frequency attenuation. Only by way of explanation, for the basic embodiment, the following theoretical calculation can be considered, in which Ms designates a mass per surface unit: Ms=25 kg/m$^2$ for the unloaded acoustic complex (without any load applied thereon) and Ms'=150 kg/m$^2$ for the loaded acoustic complex. Considering 6 pads per m$^2$ of acoustic complex, it is possible to calculate the load applied to each pad of 100 mm long and 50 mm wide. For the unloaded acoustic complex: 25/6×0.1×0.05=833 kg/m$^2$ or 25/6=4.16 kg per pad. For the loaded acoustic complex: 150/6×0.1×0.05=5000 kg/m$^2$ or 150/6=25 kg per pad. Supposing that the acoustic complex follows the mass-spring-mass law, the natural frequency of such a complex can be calculated.

For an unloaded complex, without any load:

$$F0 = \frac{1}{2\Pi}\frac{(k)^{0.5}}{(m)^{0.5}}$$

k: spring stiffness (N/m)

ms: mass per unit area (kg/m$^2$)

$$Fo = \frac{E}{2\Pi}\frac{1}{(\text{ms } e)^{0.5}}$$

E: modulus of elasticity (0.053 N/mm$^2$)

e or d: thickness of the compressed pad $Fo=84/(ms\cdot d)^{0.5}$ $Fo=84/(833\times0.035)^{0.5}=16$ Hz.

For a loaded complex:

$Fo=84/(ms\cdot d)^{0.5}$ $Fo=84/(5000\times0.035)^{0.5}=6$ Hz

Accordingly, the filtering for the most unfavourable frequency is:

$$F = 1 - \frac{1}{(E)^2} = 1 - \frac{1}{(63/16)^2} = 93\%$$
$$(Fo)^2$$

Although the above-mentioned exemplary embodiment gives good results, it is still possible to obtain best performances by using wood shims between the panels and the pads, as will be described now.

In this exemplary embodiment with shims, the rigid panels have a thickness of at least 15 mm and a mass per unit area greater than or equal to 25 kg/m$^2$. The floor covering has typically a mass per unit area comprised between 10 and 15 kg/m$^2$. The pads are of the same type than previously. Each shim has a thickness comprised between 10 mm and 25 mm. Preferably, each shim is slightly larger (and/or longer) than the corresponding pad that is stuck thereto, so that the shim can be screwed (or nailed or stapled) to the panel without having to go through the pad. The floating floor is composed of wood panel of the OSB type or equivalent, assembled together. Each panel has typical dimensions of 1250×800×22 mm and has, at the under-face thereof, screwed wood shims under which are stuck the pads of typical dimensions 100×50×17 mm. The distribution of the shims and pads between them is substantially identical to that of the previous example, i.e. a spacing of 40 cm between them.

Figure 4:
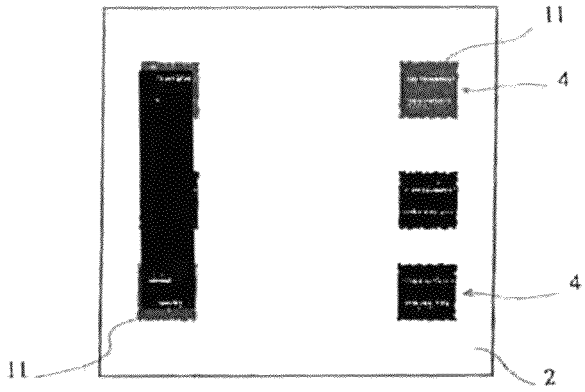
FIG. 4 illustrates a bottom (under-face) view of a prefabricated panel, in the case of pads mounted on shims.

FIG. 4 shows the distribution between the shims 11 and the pads 4 at the under-face of a panel 2. The shims are made of wood, for example pressed wood or equivalent. In this example, the shim width is slightly greater than that of the pads, so that the screw-fixation of the shims to the panel can be performed laterally to the pad, thus without having to going through the latter. The distribution of the shims and pads is equivalent to that of the pads of FIG. 3.

The typical implementation is similar to that of the previous example with, in a first time, control of the floor flatness and humidity rate, and possibly correction thereof. The panels, which are tongued and grooved and which comprise shims and their pads, are arranged on the floor and assembled together by being stuck and thus nested into each other to form the floating floor in the considered room. An expansion joint of 1.5 mm by linear meter of floor is provided along the peripheral edges of the acoustic complex. The panels are separated from the peripheral sidewalls by a foam joint placed inside the expansion joint.

In alternative embodiments of the two previous examples, it is further applied on the support a 20 to 40 mm thick layer of glass wool, on which are placed the panels with pads and possibly shims. Therefore, the glass wool is compressed at the pads, and these latter thus not rest directly on the support.

By way of example of such an alternative embodiment with shims, the inert rigid panels have a thickness of at least 15 mm and a mass per unit area greater than or equal to 25 kg/m$^2$. The floor covering stuck onto the panels has a mass per unit area comprised between 10 and 15 kg/m$^2$. The pads are of an above-described type. The shims have a thickness the value of which is chosen between 10 and 25 mm, preferably of 19 to 25 mm. The glass wool insulating material has a thickness without stress of 20 to 40 mm.

The typical implementation is similar to that of the previous examples, except that a glass wool layer is first spread/unrolled on the support.

Figure 5:
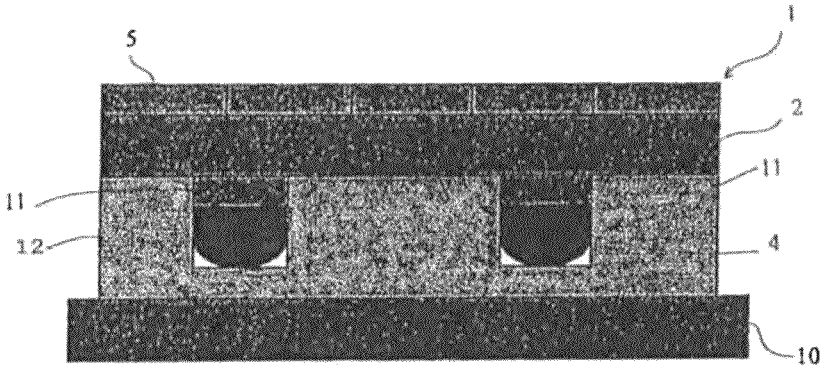
FIG. 5 illustrates a cross-sectional view of a third example of an acoustic complex made by assembling several panels with pads mounted on shims, in the case of a concrete support, and in which an insulation by packing glass wool over the whole surface of the support is further implemented.

In FIG. 5, it can be seen that the shims are directly fastened to the under-face of the panel, the pads 4 being stuck to the free face of the shims 11. In the example shown, glass wool has been spread over the whole surface of the support and is compressed by the pads. It is to be understood that these figures are oversimplified because, in reality, due to the flexibility of the glass wool, the latter substantially conforms the pad shape.

Figure 6:
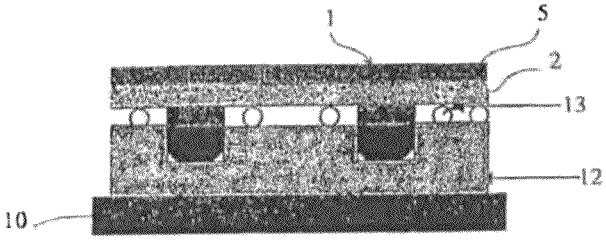
FIG. 6 illustrates a cross-sectional view of an alternative embodiment of the third example of FIG. 5, in which an electric coil heating system is further installed under the panels.

FIG. 6 shows that it is also possible to install a floor heating system by placing an electric heating coil 13 under the panels, between the pads and shims (over the glass wool 12, as shown in the Figure). Because the shims and pads are discrete elements and not continuous lines, the installation of the coil is made easy. It is to be understood that any type of canalization (electricity, telephone, television . . . or even water or else) can also be passed under the panels.

An exemplary embodiment in renovation of old building floors will now be described. The original covering of the floor (wood flooring, plaster mortar flooring) that has been removed was resting on sleepers, which are now exposed. The inert rigid panels having a thickness greater than 15 mm and a mass per unit area greater than or equal to 25 kg/m$^2$ are thus installed on said sleepers. In an alternative embodiment, without sleepers, it is possible to install the panels on joists. Panels are implemented, whose distribution of pads and possible shims is such that the pads rest effectively on the sleepers or the joists. Preferably, before installation of the panels, a packing of glass wool insulating material or equivalent is performed. This packing process is carried out either between the sleepers or joists, so the pads then rest directly on the latter, or, preferably, over the whole surface, including the sleepers or joists, so the glass wool or equivalent is compressed between the pads and the sleepers or joists. A floor coating having a mass per unit area comprised between 10 and 15 kg/m$^2$ is placed on the panels assembled together. The wood panels are of the OSB type or equivalent and are assembled together. Each panel has for dimensions 1250×800×22 mm and comprises, stuck to the under-face thereof, pads of 100×50×17 mm. In an alternative embodiment, shims are implemented. The tongued and grooved panels are assembled by being stuck together and nested in each other to form a coherent floating fool in the considered room. At the periphery, a 1.5 mm/m expansion joint is provided opposite the sidewalls/walls. The panels and the floor coating of the acoustic complex are separated from the sidewalls, at the periphery thereof, by a foam joint.

In some cases, it may be contemplated to install a heating means in the floor. The present invention makes it possible, in a very easy way, as will be explained now with an exemplary embodiment of padded panels with shims and insulation material. The inert rigid panels have a thickness greater than 15 mm and a mass per unit area greater than or equal to 25 kg/m$^2$. These panels are wood panels of the OSB type or equivalent, assembled together to form the floating floor. Each panel of 1250×800×22 mm has flexible acoustic resilient elements, the pads, having dimensions of 100×50×17 mm. In this example, these pads are arranged every 40 cm. Before installation, it must be taken care to control the floor flatness and humidity rate for a potential correction, and then to apply the glass wool over the whole surface of the space to be processed. Then, it must be taken care to install the coil floor heating system, which in this case is electric, according to the manufacturer instructions, onto the glass wool, which will then be compressed. The tongued and grooved panels are then placed to the floor, without contact with the electric heating system. These panels are assembled together by being stuck together and thus nested to each other to form a coherent floating floor in the considered room. The floor coating having a mass per unit area comprised between 10 and 15 kg/m$^2$ is then applied. A 1.5 mm/m expansion joint is provided opposite the peripheral sidewalls. The acoustic complex is separated from the peripheral sidewalls by a foam joint.

Experimentations in laboratory have shown very high impact noise acoustic insulation performances, with a significant low-frequency attenuation. The results of the measurements made in laboratory give a performance ΔLw=29 dB for an acoustic complex without glass wool and ΔLw=31 dB for an acoustic complex with glass wool, and this for a 14 cm concrete slab. Such a performance is still unequalled today. Besides, the attenuations are very high at low frequency (15 to 30 dB according to the configuration and frequency band), which is fundamental for the impact noises; indeed, low frequencies are highly perceptible by the human ear. Today, no equivalent technical method meets such performances.

The acoustic measurements have been carried out in a laboratory made according to the NF EN 140-6 standard, except for the standardized dimensions. The equipment used consisted in an impact machine Butelec® and a sound-level meter 2260 Bruel & Kjaer®. The floor of the laboratory is made of a 140 mm-thick concrete slab, on which various acoustic complexes have been tested. By way of example, the following floor configurations for tests can be mentioned:

Configuration 1: an acoustic complex on a 140 mm-thick reinforced concrete slab support, the acoustic complex comprising: 17 mm-thick pads with 19 to 25 mm-thick shims on a modular wood panel of 15 kg/m$^2$, the whole being covered with a floor covering of 10 kg/m$^2$.

Configuration 2: an acoustic complex on a 140 mm-thick reinforced concrete slab support, with interposition of a 40 mm-thick glass wool layer (20 kg/m$^3$), the acoustic complex comprising: 17 mm-thick pads with 19 to 25 mm-thick shims on a modular wood panel of 15 kg/m$^2$, the whole being covered with a floor covering of 10 kg/m$^2$.

With Configuration 1, the measurement results were as follows:

Result of the Impact Noise Insulation Measurements

| Frequency (Hz) | Lno(dB) | ΔL(dB) |
|---|---|---|
| 100 | 59 | −3 |
| 125 | 55 | 3 |
| 160 | 55 | 12 |
| 200 | 64 | 18 |
| 250 | 59 | 21 |
| 315 | 57 | 23 |
| 400 | 61 | 21 |
| 500 | 54 | 27 |
| 630 | 53 | 29 |
| 800 | 50 | 33 |
| 1000 | 46 | 38 |
| 1250 | 44 | 35 |
| 1600 | 40 | 42 |
| 2000 | 43 | 38 |
| 2500 | 41 | 38 |
| 3150 | 37 | 40 |
| 4000 | 38 | 38 |

Impact noise acoustic attenuation index:

According to XP S 31074 ΔL=28 dB (A) (tolerance±2 (dB))

According to NF EN ISO 717-2 ΔLw=29 dB

With Configuration 2, the measurement results were as follows:

Result of the Impact Noise Insulation Measurements

| Frequency (Hz) | Lno(dB) | ΔL(dB) |
|---|---|---|
| 100 | 60 | −4 |
| 125 | 57 | 6 |
| 160 | 55 | 14 |
| 200 | 61 | 21 |
| 250 | 58 | 26 |
| 315 | 50 | 30 |
| 400 | 56 | 27 |
| 500 | 49 | 32 |
| 630 | 48 | 34 |
| 800 | 47 | 36 |
| 1000 | 44 | 40 |
| 1250 | 41 | 38 |
| 1600 | 39 | 43 |
| 2000 | 39 | 41 |
| 2500 | 37 | 41 |
| 3150 | 35 | 42 |
| 4000 | 33 | 43 |

Impact noise acoustic attenuation index:

According to XP S 31074 ΔL=30 dB (A) (tolerance±2 (dB))

According to NF EN ISO 717-2 ΔLw=31 dB

It is to be noted that, on site, to add 1 dB by cm of concrete can be added, i.e. 35 and 37 dB for a 20 cm slab.

These results are obtained in a simple way and with a cost substantially equivalent to that of a conventional acoustic floating screed, because it is a dry construction process implementing an easy-handling simple assembling of modular panels. The obtained acoustic complex is six times lighter than a conventional acoustic floating screed. This method also makes it possible to avoid the phonic bridges, because there is no springing of elements on the concrete slab forming the support, unlike an accidental concrete leakage in the case of a floating screed. Moreover, it is possible in case of disaster to selectively replace the damaged modular panel. The invention preferably uses recycled materials of the OSB type for the floor and the possible shims, and materials based on recycled rubber for the pads. The selected materials have been using for 50 years for the rubber pads and the OSB is of the M3 class water-repellent type. These materials are thus ecological and can find applications in floors for ecological wood frame house or other. The construction process of the invention allows the making of a low-temperature heating floor, with a heating means placed between the insulating material and the under-face of the floating floor because of the small thickness of the acoustic complex and the density of the constitutive elements thereof. This permits significant energy savings because a lesser heating will be required to obtain the same surface temperature.

In practice, to obtain the best results, it is preferred to implement an acoustic complex that comprises a floating floor with shims, and this, with or without glass wool. Indeed, to reinforce the impact noise insulation performances, it is preferable to apply the wood panels on shims having a thickness comprised between 15 mm and 20 mm. Under these shims are stuck the pads. On the floating floor, at the surface of the panels, is stuck a floor coating of the massive wood flooring or heavy tiling type. This floor coating has a mass per unit area of at least 10 kg/m$^2$ (DINACHOC® type). The floating floor (thus, without floor coating) has a mass per unit area of at least 15 kg/m$^2$ for panels of OSB type or equivalent. It results that the acoustic complex (floating floor+floor coating) has a mass per unit area of 25 kg/m$^2$ at the minimum. It is noticed that, in case of underload, the acoustic complex efficiency is strongly deteriorated and, in the worse case, does not operate anymore. Such an acoustic complex may be applied on any type of floor: new or old ones, and with any type of support: concrete, wood, slabs . . . .

The following Table sum-up the situation, with comparison to the conventional device of the concrete floating screed type:

| Concrete floating screed | Wood panel acoustic complex | Gain of Performances |
|---|---|---|
| Load | | |
| 90 kg/m$^2$ | 15 kg/m$^2$ | 6 times lighter |
| Implementation | | |
| 4 to 6 weeks of drying | Immediate | Gain of 1 to 1.5 months on the work site |
| Attenuation performance | | |
| For a 14 cm slab, Δ Lw = 21 dB | ΔLw = 29 dB without glass wool<br>ΔLw = 31 dB with glass wool | Gain of 8 to 10 dB |
| Low-frequency attenuation | Significant low-frequency attenuation | In the band (125, 500 Hz): 6 dB at 125 Hz to 32 dB at 500 Hz |

It is to be understood that the invention may be adapted in various ways without thereby departing from the general scope defined by the present application. For example, the floor coating, instead of being installed on site once the panels assembled together to form the floating floor, may be stuck in factory on each panel, to obtain a fully prefabricated panel. Any way and preferably, ex-factory, the panels have at least the pads fastened thereto, with possibly shims for the embodiment with shims. In more unusual cases of "custom-made" products, it may be necessary to fasten the pads and the possible shims, in situ on the work site, to adapt the product to particular conditions as, for example, an unusual sleeper or joist spacing. Likewise, the panels may be made of any suitable rigid material and the panel dimensions may be different from those described above by way of example. Therefore, the panels may have a dimension (length and/or width—square or rectangular panel) that is a function of the standard spacing between joists of dwellings (in general, the spacing is 40 cm). Likewise, the panel shapes may be different from a square or rectangle, and may for example be polygonal. In the latter case, this panel shape may correspond to the shape unit (or a multiple thereof) of the floor coating that is used (for example, ceramic or marble tiles or traditional flooring: Versailles).

The invention claimed is:

1. An acoustic complex (1) for making a floating floor with improved acoustic insulation performance, the acoustic complex comprising:

a floor covering (5) fastened to a floating floor resting on a support (3) (10), said floating floor comprising a modular set of rigid prefabricated panels (2), elastic pads (4) and wood shims, the elastic pads and wood shims being arranged on a lower face of the panels, between the panels and the support, wherein the floating floor is formed of the modular set of rigid prefabricated panels (2) having a density between 0.5 and 6 g/cm$^3$, limits included, the panels comprising peripheral edges configured for positioning the panels edge-to-edge in order to form a continuous upper surface, at least one of said peripheral edges of each panel comprising a means for adjusting an edge-to-edge positioning of the panels, the means for adjusting comprising complementary male and female structures configured to come into mutual engagement, wherein the elastic pads are homogenous single-piece elements fastened indirectly by the wood shims to the lower face of the panel, each of said elastic pads being substantially of parallelepiped shape, the ratio (Sta/Stp) of the total seating surface area (Sta) of the elastic pads on the support to the total surface area of the panel (Stp), being between 0.03 and 0.08, wherein the wood shims have a thickness between 19 and 25 mm, and wherein the elastic pads are fastened to the wood shims such that the wood shims have slightly longer length than that of corresponding elastic pads fastened thereto, the wood shims being fastened under the panel, and the elastic pads and the wood shims forming parallel discontinuous lines.

2. The acoustic complex according to claim 1, wherein the elastic pads (4) are made of an elastic material having the following mechanical characteristics: a static modulus of elasticity of about 0.10 to 0.44 N/mm$^2$ and a dynamic modulus of elasticity of about 0.15 to 1.10 N/mm$^2$, a compression strain of about 4.1%, a tensile strength of about 0.3 N/m, an elongation at break: 60%, a tear strength of about 3 N/mm.

3. The acoustic complex according to claim 1, wherein said floor covering is fastened to an upper face of the rigid panels, said floor covering having a surface density of a least 10 kg/m$^2$.

4. The acoustic complex according to claim 1, wherein the acoustic complex has a mass per unit area of at least 25 kg/m$^2$, the floating floor having a mass per unit area of at least 15 kg/m$^2$.

5. The acoustic complex according to claim 1, wherein the elastic pads have dimensions of about 100 mm×50 mm×17 mm and the panel dimensions are about 1250 mm×800 mm×22 mm.

6. The acoustic complex according to claim 1, wherein fasteners fasten the shims to the panels without extending through the corresponding elastic pads.

7. The acoustic complex according to claim 6, wherein the fasteners fasten to an edge of the shims overhanging the corresponding elastic pads so that the fasteners do not extend through the corresponding elastic pads.

8. A method of making an acoustic complex forming a floor with improved acoustic insulation performance, comprising:

preparing a floating floor having a continuous upper surface, comprising rigid prefabricated panels (2), wood shims, and elastic pads, the elastic pads being homogenous single-piece elements fastened indirectly to a lower face of the rigid prefabricated panels; and providing a floor covering (5) fastened to the floating floor and resting on a support (3) (10), wherein the step of preparing the floating floor comprises the sub-steps of:

placing edge-to-edge a modular set of said rigid prefabricated panels (2), having a density between 0.5 and 6 g/cm$^3$, limits included, the rigid prefabricated panels each comprising peripheral edges, at least one of said peripheral edges of each rigid prefabricated panel comprising a means for adjusting an edge-to-edge positioning of the rigid prefabricated panels, the means for adjusting comprising complementary male and female structures placed into mutual engagement, and fastening the wood shims, having a thickness between 19 and 25 mm, under the rigid prefabricated panels between the lower face of the panels and each of the elastic pads, each shim being slightly larger than a corresponding pad that is in connection therewith, and the elastic pads and the wood shims forming parallel discontinuous lines, each of said elastic pads being substantially of parallelepiped shape and a ratio (Sta/Stp) of a total seating surface area (Sta) of the elastic pads on the support to a total surface area of the rigid prefabricated panels (St) being between 0.03 and 0.08.

9. The method according to claim 8, further comprising:

placing strips of a resilient material (6) between a periphery of the acoustic complex and walls of a room in which the acoustic complex is located.

10. The method according to claim 9, wherein each shim is fastened to one of the panels via fasteners that do not extending through the corresponding elastic pad.

11. The acoustic complex according to claim 10, wherein, for each shim, the fasteners fasten to an edge of the shim that overhangs the corresponding elastic pad so that the fasteners do not extend through the corresponding elastic pad located between the shim and the panel.

12. The method according to claim 8, further comprising:

placing a layer of insulating fibrous material on an entire upper surface of the support in such a manner that said fibrous material is compressed between the elastic pads and the support.

13. The method according to claim 12, further comprising:

placing strips of a resilient material (6) between a periphery of the acoustic complex and walls of a room in which the acoustic complex is located.

* * * * *

UNITED STATES PATENT AND TRADEMARK OFFICE

CERTIFICATE OF CORRECTION

PATENT NO. : 8,596,003 B2
APPLICATION NO. : 12/921803
DATED : December 3, 2013
INVENTOR(S) : Attia et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 80 days.

Signed and Sealed this
Twenty-second Day of September, 2015

Michelle K. Lee

Michelle K. Lee
*Director of the United States Patent and Trademark Office*